US008911331B2

(12) United States Patent
DeBlanco

(10) Patent No.: US 8,911,331 B2
(45) Date of Patent: Dec. 16, 2014

(54) TRAMPOLINE PARK FRAME

(71) Applicant: Joseph R. DeBlanco, Las Vegas, NV (US)

(72) Inventor: Joseph R. DeBlanco, Las Vegas, NV (US)

( * ) Notice: Subject to any disclaimer, the term of this patent is extended or adjusted under 35 U.S.C. 154(b) by 0 days.

(21) Appl. No.: 14/222,997

(22) Filed: Mar. 24, 2014

(65) Prior Publication Data

US 2014/0206505 A1 Jul. 24, 2014

Related U.S. Application Data

(63) Continuation of application No. 13/753,455, filed on Jan. 29, 2013.

(60) Provisional application No. 61/593,513, filed on Feb. 1, 2012.

(51) Int. Cl.

| | |
|---|---|
| ***A63B 5/11*** | (2006.01) |
| *A63B 71/00* | (2006.01) |
| *A63B 71/02* | (2006.01) |

(52) U.S. Cl.

CPC ..... *A63B 5/11* (2013.01); *A63B 2071/0063* (2013.01); *A63B 2071/024* (2013.01); *A63B 2209/10* (2013.01)

USPC ..... 482/27

(58) Field of Classification Search

CPC ..... A63B 5/00; A63B 5/02; A63B 5/04; A63B 5/08; A63B 5/10; A63B 5/11; A63B 5/16

USPC ..... 482/23, 26, 27, 28, 29, 30, 31, 32; 472/105, 135; 248/548; 267/136

See application file for complete search history.

(56) References Cited

U.S. PATENT DOCUMENTS

| | | | | |
|---|---|---|---|---|
| 3,233,895 | A | 2/1966 | Grelle et al. | |
| 3,635,471 | A | 1/1972 | Caron | |
| 4,068,404 | A * | 1/1978 | Sheldon | 47/22.1 |
| 5,624,122 | A | 4/1997 | Winkelhorn | |

(Continued)

FOREIGN PATENT DOCUMENTS

| | | |
|---|---|---|
| FR | 2238508 | 2/1975 |
| SU | 1653793 | 6/1991 |

OTHER PUBLICATIONS

Vladimirova, T., Authorized Officer of ISA, "Notification of Transmittal of the International Search Report and the Written Opinion of the International Searching Authority, or the Declaration", for PCT US2013/023691, 2 pages, Apr. 18, 2013.

(Continued)

*Primary Examiner* — Loan H Thanh
*Assistant Examiner* — Nyca T Nguyen

(57) ABSTRACT

A support frame for the multiple jumping surfaces making up a trampoline park utilizes multiple trampoline support grid arrays, each consisting of support cable segments supported by a rectangular array of individual support columns. Each cable segment is attached to a separate pair of support columns within the array. Diagonal cross-brace cables likewise are attached to and extend between each separate pair of support columns. The adjacent paired support columns support the individual trampoline beds, with the loading occasioned by jumping users rapidly transferred to ground—the vertical loading through the support columns and the horizontal loading through the diagonal cross-brace cabling. The support frame includes peripheral support grid arrays having an outer grid of peripheral support columns with attached kick braces extending to adjacent outer support columns, completing the peripheral horizontal load paths.

17 Claims, 10 Drawing Sheets

(56) References Cited

U.S. PATENT DOCUMENTS

| | | | | |
|---|---|---|---|---|
| 6,135,922 | A * | 10/2000 | Nissen | 482/27 |
| 6,988,967 | B2 * | 1/2006 | Allison | 473/473 |
| 7,468,020 | B2 | 12/2008 | Lai | |
| 8,657,696 | B1 * | 2/2014 | Gurley | 472/92 |
| 2007/0010374 | A1 * | 1/2007 | Widich | 482/27 |
| 2009/0023558 | A1 | 1/2009 | VanElverdinghe | |
| 2010/0210422 | A1 * | 8/2010 | Crawford | 482/27 |

OTHER PUBLICATIONS

Selivanov, V., Authorized Officer of ISA/FIPS, "Written Opinion of the International Searching Authority", for International Application No. PCT/US/2013/023691, 5 pages, Apr. 18, 2013.

* cited by examiner

TRAMPOLINE PARK FRAME

RELATED APPLICATIONS

This application is a continuation of co-pending U.S. patent application Ser. No. 13/753,455, which was filed on Jan. 29, 2013, and claims the benefit of U.S. Provisional Patent Application, Ser. No. 61/593,513, filed Feb. 1, 2012; both identified applications are incorporated by reference herein for all that they contain.

BACKGROUND OF THE INVENTION

1. Field of the Invention

The present invention relates to trampoline parks where a framework supports multiple, individual jumping surfaces, and more particularly, to a trampoline park where individual jumping surfaces are supported by a cabling support network. More specifically, the present invention relates to a trampoline park support framework that utilizes multiple cable segments supported by a rectangular array of cross-braced individual columns.

2. Description of the Related Art

Trampoline parks have become a new recreational venue throughout the country. Multiple fabric sections are each connected by a large number of springs to a network of rigid supports. Each of the fabric sections creates a jumping surface, with the array of trampolines defined by the jumping surfaces and support network permitting users to travel from one jumping surface to another over a considerable area.

Consumer Product Safety Commission standards require padding to cover the metal frame, hooks and all springs to reduce the risk of injury should a jumper inadvertently land on this frame instead of the trampoline fabric section. Notwithstanding the implementation of such padding there continues to be many visits to Emergency Rooms every year as a result of trampoline impact injuries, with trampoline parks having an increased risk of such between-the-trampoline-fabric impacts due to their multiple, adjacent jumping surfaces.

Multiple rigid rods, each extending the length and width of a jumping surface, traditionally have been used to construct the support frame network. A large number of springs connect the jumping surface to the surrounding frame of rigid rods to create a functional trampoline. The trampolines of Grelle et al., U.S. Pat. No. 3,233,895, are of this general nature.

An alternative support system is shown in Winkelhorn, U.S. Pat. No. 5,624,122, where a grid of transverse steel cables are used to form the supports for a rectangular array of jumping surface panels. The transverse cables are spaced apart a distance substantially equal to the length and width of the panels, with springs extending from the cables and attached to the panels. This cable grid is supported at the periphery by several heavy supporting poles.

The use of cables to form the support frame for the jumping panel surfaces is considered an improvement over the inflexible metal frames, such as are shown in Grelle et al. Unfortunately, a fully suspended cable grid, as is taught by Winkelhorn, is encumbered by load path considerations of cable constructions. All of the tension/load of the cables is transferred to the periphery of the grid and then to the ground through the "heavy supporting poles." The anchoring of such poles is not always compatible with construction requirements typical of commercial mixed-use developments.

Such manner of suspended cable support also is not able to provide the vertical stiffness that is desirable when supporting the jumping surface panels. In response to impacts by users upon the jumping surfaces the suspended supporting grid permits a flexing, up and down movement, of the jumping surfaces. Such vertical motion is undesirable and detrimentally affects the perceived "jump quality" of the jump surfaces. A need exists for the greater "give" to reduce jumper injuries provided by cable panel supports over the stiff frame supports without sacrificing the beneficial jumping panel stiff support characteristics of the rigid support frame.

SUMMARY OF THE INVENTION

The present invention provides an indoor trampoline park frame system that utilizes multiple cable segments supported by a rectangular array of cross-braced individual columns instead of rigid members to construct the lateral top support chord for each side of the jumping panels. These cable segments are placed under protective padding when made ready for use.

Cross-bracing of the support columns to each of the adjacent support columns forming the rectangular array enables this support column array to provide a short load path to the ground for both vertical and horizontal loading, with little to no column-to-column transfer of force. By minimizing the accumulation of loading forces the ground anchoring requirements of the individual columns is minimized, enabling quick and lower-cost installation of the trampoline park frame system of the present invention within conventional commercial buildings. Such lower cost installation also enables the quick and complete removal of the present frame system should a different commercial use of the space be desired.

In a further aspect of the present invention a trampoline park frame comprising: a plurality of support columns arranged in a rectangular grid array; a plurality of support cabling, each of said plurality of support cabling individually attached to and extending between a separate adjacent pair of said plurality of support columns in a manner such that collectively said plurality of attached support cabling and said support columns define a plurality of trampoline support grid arrays; a plurality of cross-brace cabling, each of said plurality of cross-brace cabling attached to and extending between a separate one of said separate adjacent pairs of said plurality of support columns; a plurality of peripheral support columns extending in a grid array about an outer periphery of said plurality of trampoline support grid arrays, wherein a separate one of said plurality of support cabling is attached to and extends between each of said plurality of peripheral support columns and a separate adjacent one of said plurality of support columns; a plurality of kick braces, each of said plurality of kick braces is attached to a separate one of said plurality of peripheral support columns and extends and is attached to said separate adjacent one of said plurality of support columns to which said separate one of said plurality of support cabling is attached; and a plurality of peripheral rails, each of said plurality of peripheral rails is attached to and extends between a separate pair of said plurality of peripheral support columns.

In a still further aspect of the present invention a trampoline park comprising: a trampoline park frame having a plurality of trampoline support grid arrays arranged in parallel rows, each comprising: a plurality of support columns arranged in a grid array, a plurality of support cabling, each of said plurality of support cabling individually attached to and extending between a separate adjacent pair of said plurality of support columns, and a plurality of cross-brace cabling, each of said plurality of cross-brace cabling attached to and extending between a separate one of said separate adjacent pairs of said plurality of support columns; and a plurality of trampoline beds, each of said plurality of trampoline beds received in and attached to a separate one of said plurality of trampoline support grid arrays.

It is to be understood that the invention is not limited in its application to the details of construction and the arrangement of components described hereinafter and illustrated in the drawing figures. Those skilled in the art will recognize that various modifications can be made without departing from the scope of the invention.

BRIEF DESCRIPTION OF THE DRAWINGS

Embodiments in accordance with the present invention are described below in connection with the accompanying drawings.

DETAILED DESCRIPTION OF THE PREFERRED EMBODIMENTS

Figure 1:
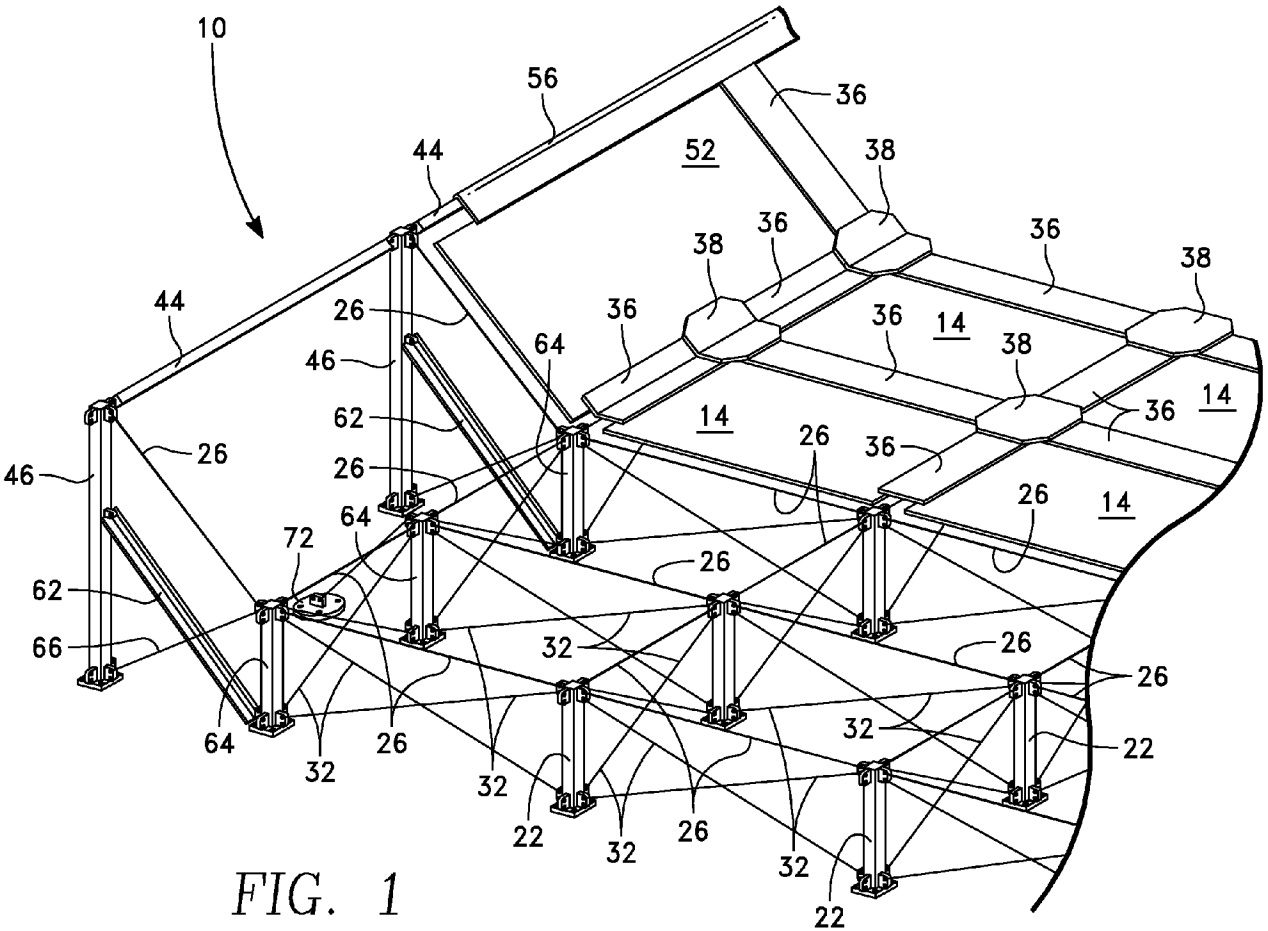
FIG. 1 is a partial perspective view, with portions broken away, of a trampoline park frame in accordance with the present invention.

Reference is now made to the drawings wherein like structures refer to like parts throughout. In FIG. 1 a trampoline park frame 10 is shown placed upon a floor 12, the trampoline park frame 10 supporting a plurality of trampoline beds 14. A plurality of bed support columns 22 arranged in a grid array each have a plurality of trampoline bed support cabling 26 extending in an orthogonal manner to adjacent bed support columns 22, together forming a plurality of rectangular trampoline support grid arrays 28 (see FIG. 3). A pair of diagonal cross-brace cabling 32 extends between each pair of adjacent bed support columns 22 providing a short load path for horizontal loading applied to the bed support columns 22.

Overlying each segment of the trampoline support cabling 26 is a trampoline protective pad 36 provided to minimize the risk of injury upon the inadvertent impact of a jumper against the support cabling 26. A support column protective pad 38 overlies each of the bed support columns 22, providing similar protection to jumpers inadvertently landing upon or immediately adjacent to one of the bed support columns 22.

The outer extent of the trampoline park frame 10 is defined by a plurality of peripheral rails 44 that extend between a plurality of peripheral support columns 46, the latter being taller than the bed support columns 22. Each of the plurality of peripheral support columns 46 is attached to a separate one of the trampoline bed support cabling 26, which extends from an attachment to an adjacent one of the bed support columns 22. A plurality of peripheral support grid arrays 30 are formed, and are sloping as a result of the taller peripheral support columns 46, resulting in a series of banked trampoline beds 52 extending about the periphery of the trampoline park frame 10. A peripheral rail protective pad 56 overlies the peripheral rail 44 providing the same type of protection as with the trampoline and support column protective pads 36, 38.

Figure 3:
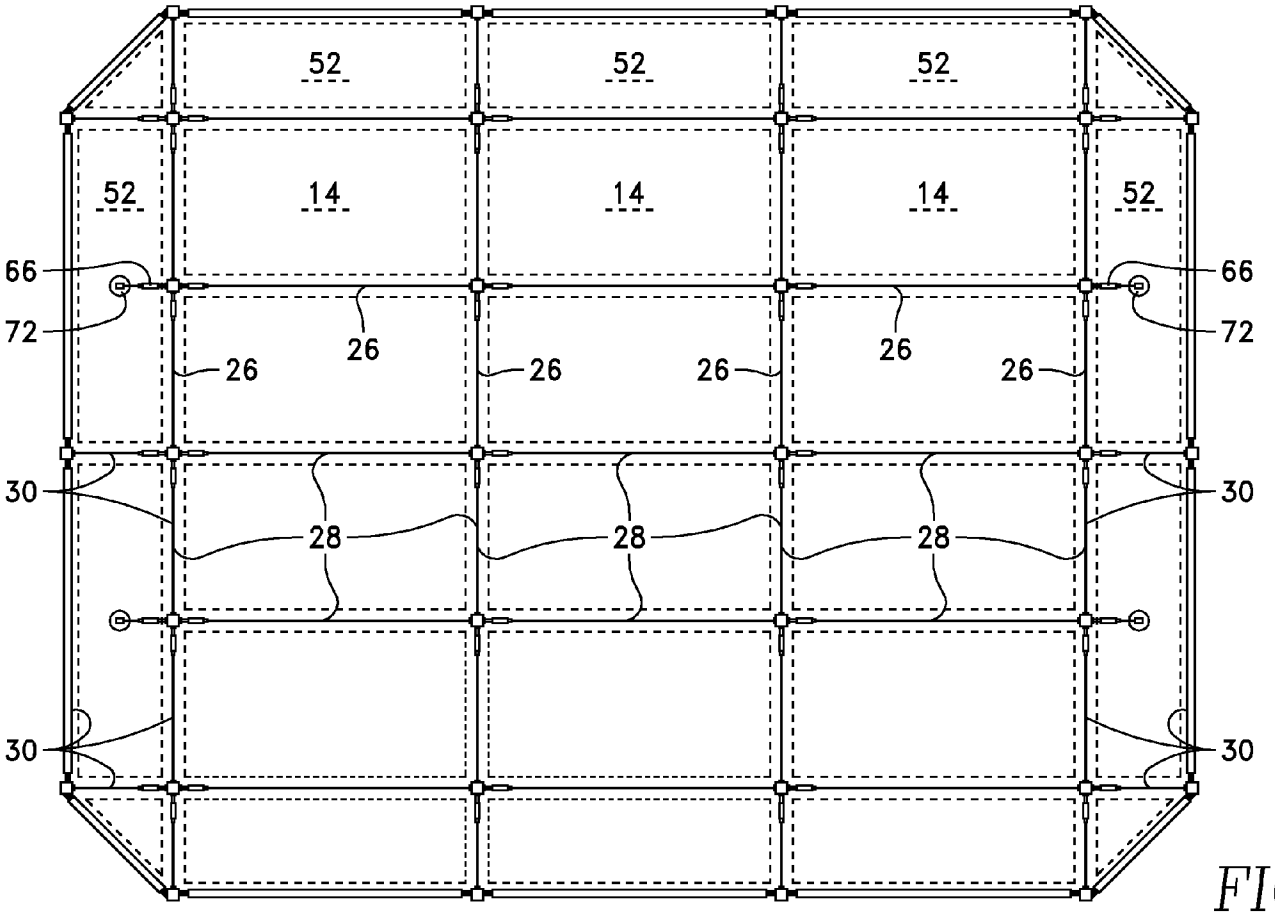
FIG. 3 is a top plan view, with portions shown in phantom, of a support frame of a trampoline park in accordance with the present invention.

A kick brace 62 is attached to each of the peripheral support columns 46 at a mid-section level thereof and extends to a location of attachment at the base of an adjacent, outer peripheral bed support column 64. A downward cable assembly 66 extends from an attachment point located at the top of one of the outer peripheral bed support columns 64 to either a base of the adjacent peripheral support column 46 or, if there is no adjacent peripheral support column 46, to a floor cable anchor plate 72. As shown in FIG. 3, the peripheral support columns 46 and the floor cable anchor plates 72 preferably extend about the periphery of the trampoline park frame 10 in a somewhat alternating manner.

Figure 2:
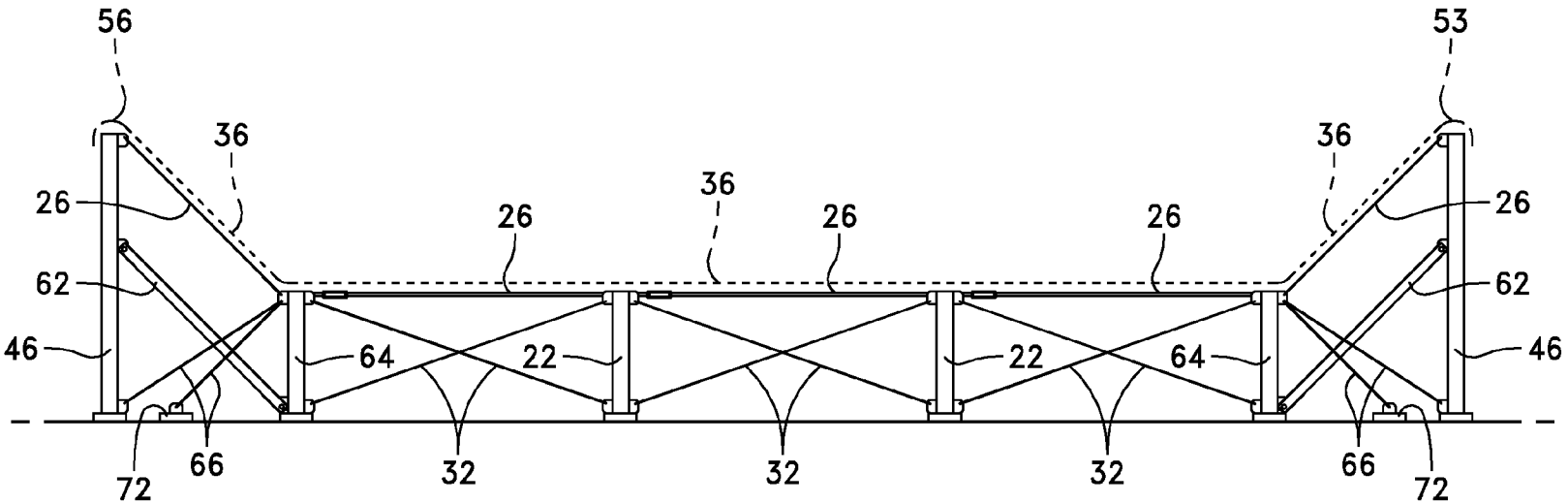
FIG. 2 is a cross-sectional view taken along line 2-2 of FIG. 6 of a trampoline park frame in accordance with the present invention.

The manner in which a short load path to ground is provided for both vertical and horizontal loading of the trampoline park frame is best shown with reference to FIGS. 2 and 3. The trampoline bed support cabling is segmented into the individual support cables 26 extending between adjacent pairs of the bed support columns 22, with each of the bed support columns providing an immediate vertical load path-to-ground.

The diagonal cross-brace cabling 32 extends between the top ends of the bed support columns 22 to the bottoms of the adjacent pairs of the bed support columns 22. Horizontal loading applied to each of the bed support columns 22 is taken to ground through the diagonal cross-brace cabling 32 to the base of the adjacent bed support column 22. Such cabling minimizes the amount of bending moment applied to the bed support columns 22 by horizontal loading. Additionally, since the bed support columns 22 have less loading as compared to the more massive peripheral cable supports of the prior art, the minimized wall thickness of the present bed support columns 22 provides a whipping impulse in response to loads applied by jumpers, further enhancing the jumping experience.

As is best shown in FIG. 3 the trampoline bed support cabling 26 extends from adjacent pairs of bed support columns 22 to form the trampoline support grid arrays 28 to which the trampoline beds 14 are attached. Jumper impacts upon the trampoline beds 14 result in loading of the bed support cabling 26, which in turn transfers the loads to the individual bed support columns 22. Such cable loading is provided short paths to ground through the individual bed support columns 22 as discussed above.

Figure 4:
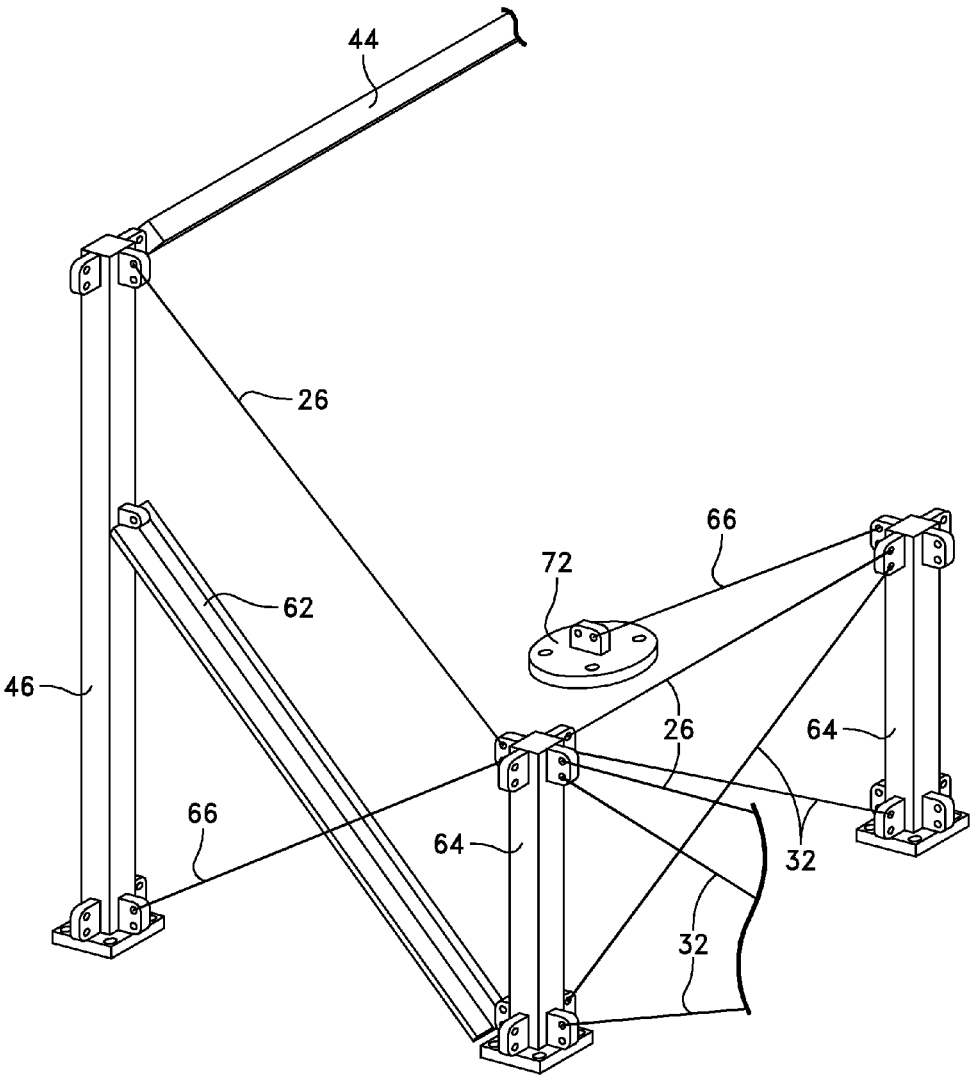
FIG. 4 is a partial perspective view of support columns and outer peripheral cabling of a trampoline park frame in accordance with the present invention.

Load transfer paths for the outer periphery of the trampoline park frame are illustrated in FIG. 4. The downward cable assembly 66 completes the transfer of horizontal loading applied to the outer peripheral bed support columns 64, providing a load path to the floor 12 either through attachment to the base of the peripheral support columns 46 or through attachment to the floor cable anchor plate 72. Horizontal loadings applied to the peripheral support columns 46 are transferred to the base of the outer peripheral bed support columns 64 using the kick braces 62, which resist the inward bending of the peripheral support column 46 as a result of forces generated by user impact against the banked trampoline bed 52 (shown in FIGS. 1 and 3).

Figure 5:
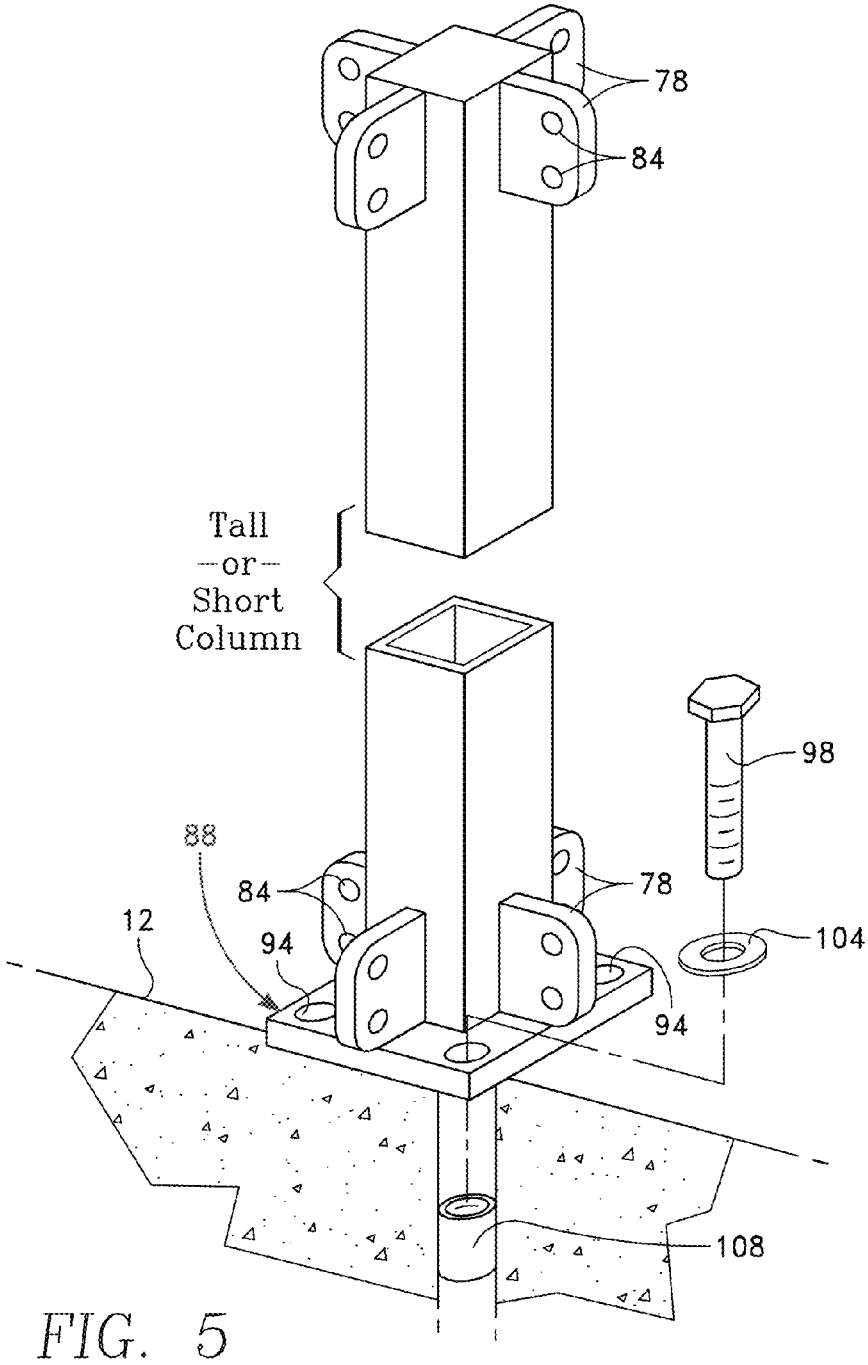
FIG. 5 is an enlarged, partial perspective view, with portions broken away and portions shown in an exploded view, of a manner of anchoring a support column of a trampoline park frame to a support surface in accordance with the present invention.

Vertical members of the trampoline park frame include the peripheral support columns 46 and the bed support columns 22 (the latter are identified as outer peripheral bed support columns 64 when located at the periphery of the plurality of trampoline beds 14). FIG. 5 illustrates the common features of these tall and short vertical members as well as a presently preferred manner of attaching these members to the floor 12.

Both the taller peripheral support columns 46 and the shorter bed support columns 22, 64 have four gusset plates 78 attached adjacent to each end of the columns and projecting therefrom in an orthogonal manner. A pair of vertically-aligned apertures 84 are formed in each of the gusset plates 78, providing a location of attachment for the trampoline bed support cabling 26, the cross-brace cabling 32, and the downward cable assembly 66 (no cabling is shown in FIG. 5).

A base plate 88 is attached to an end of each of the support columns 22, 46, 64 and a plurality of anchor apertures 94 are formed in each of the base plates 88. A plurality of anchor bolts 98 are received through each of the anchor apertures 94 and are used to secure the columns 22, 46, 64 to the floor 12 (shown as a concrete building slab in FIG. 5). This securing connection includes the anchor bolt 98, an anchor washer 104 and, preferably, a concrete screw anchor 108 (lag anchor bolts and epoxy bolts can also be used for this purpose).

Figure 6:
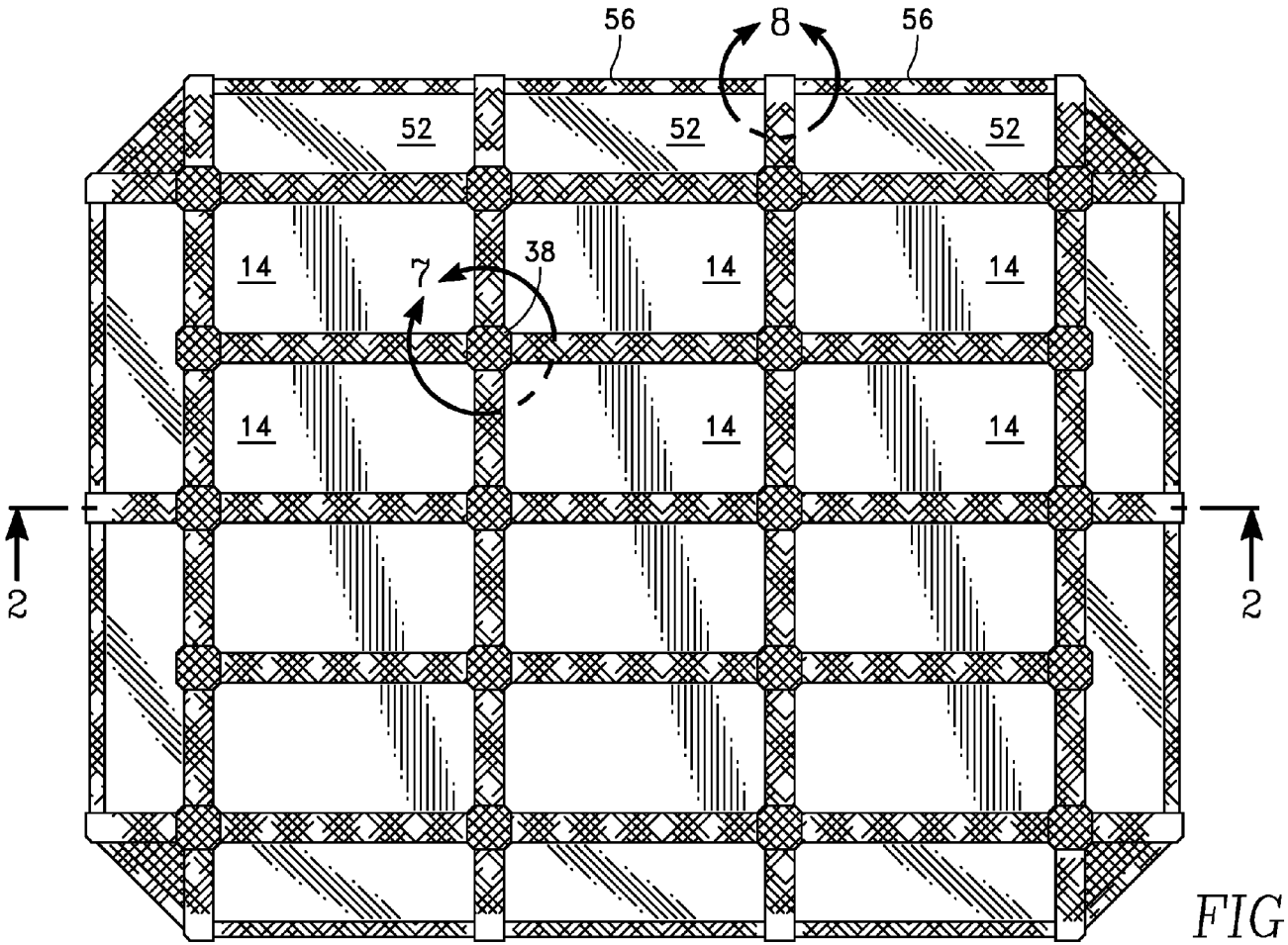
FIG. 6 is a top plan view, similar to FIG. 4, of a trampoline park in accordance with the present invention.

For purposes of illustration, and not limitation, the trampoline park supported by the trampoline park frame (discussed above) is shown in FIG. 6 as rectangular in configuration. Individual configurations of trampoline parks will vary as required by the building layout into which it is placed as well as commercial considerations of the trampoline park operator.

Figure 7:
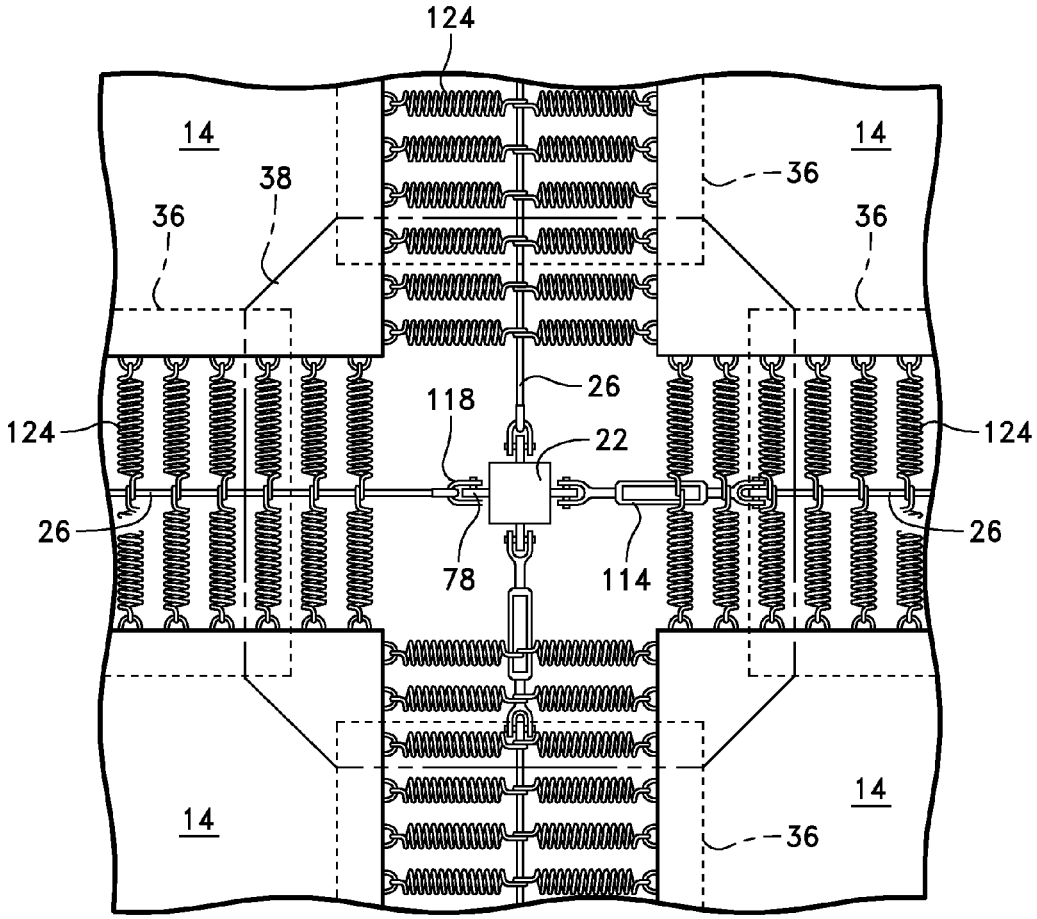
FIG. 7 is an enlarged plan view, with portions shown in phantom, taken of the encircled area 7 of FIG. 6.

The manner of attachment of the trampoline beds 14 to the trampoline support grid arrays 28 (FIG. 3) is best shown with reference to FIG. 7. Trampoline bed support cabling 26 extends between adjacent bed support columns 22, with the required tensioning obtained for each cable through use of a turnbuckle 114. Each end of the cable is formed into a loop around a cable thimble (not shown in the drawings); the free end is looped around the thimble and fastened with a swaged connection to form an eye-hole at the cable end. A shackle 118 is then used to connect the cable end, so formed, to the gusset 78, thereby obtaining a positive structural connection at each end of the cable. The resulting connection obtains a "Working Load Limit" based upon the manner and parts used in the swaging process.

The trampoline bed support cabling connections are obtained by connecting a cable end to the shackle 118, which in turn is connected to the column gusset plate 78 of the support column 22. A second cable end is connected to a first end of the turnbuckle 114, with a second end of the turnbuckle 114 connected to the shackle 118 and the column gusset plate 78 on the next adjoining bed support column 22.

A plurality of springs 124 are then secured to the trampoline support cabling 26, followed by installation and the subsequent tensioning of the trampoline beds 14. Upon completion of final tensioning adjustment of the trampoline bed support cabling 26, the trampoline protective pads 36 and the support column protective pads 38 are set in place to complete the assembly of the trampoline support grid array 28.

Figure 8:
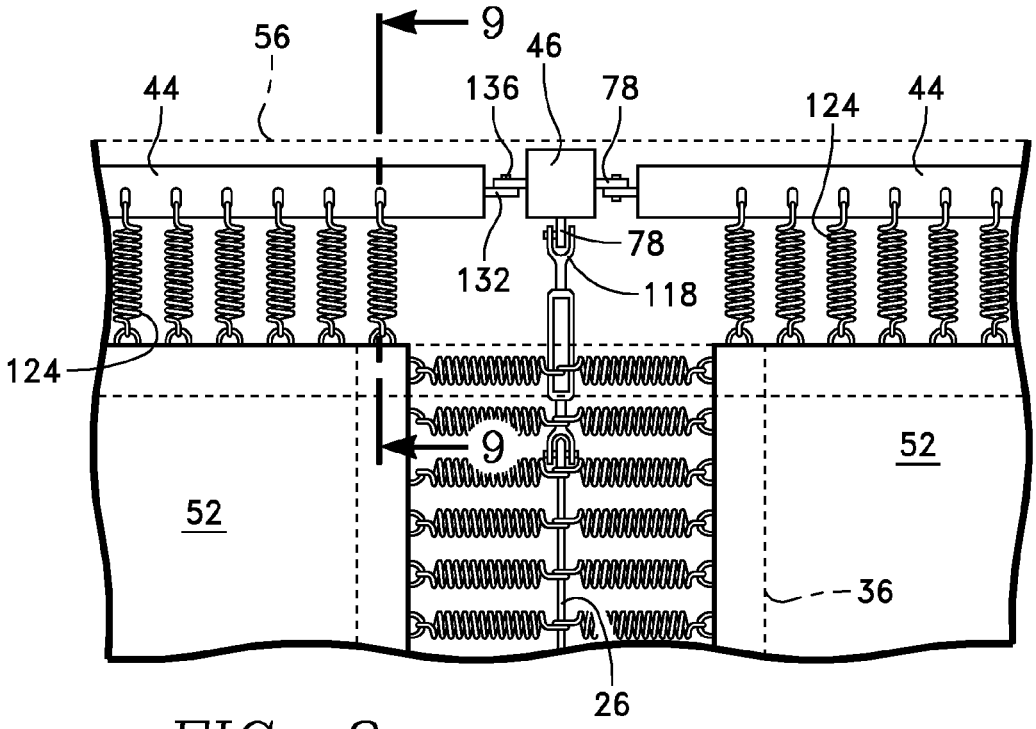
FIG. 8 is an enlarged plan view, with portions shown in phantom, taken of the encircled area 8 of FIG. 6.

FIG. 8 illustrates the manner of attachment of the banked trampoline bed 52, the trampoline support cabling 26, and the peripheral rail 44. The trampoline bed support cabling 26 is attached to the gusset plate 78 of the peripheral support column 46 in much the same manner as to the bed support columns 14 and peripheral support column 46—the shackle 118 attached to either the support cabling 26 or to the turnbuckle 114 (as is shown in FIG. 8). A rail gusset plate 132 is attached to each end of the peripheral rails 44 and apertures formed therein may be aligned with the gusset apertures 84 in the column gusset plates 78 to enable attachment of the peripheral rails 44 to the peripheral support columns 46 using a rail connector 136.

Figure 9:
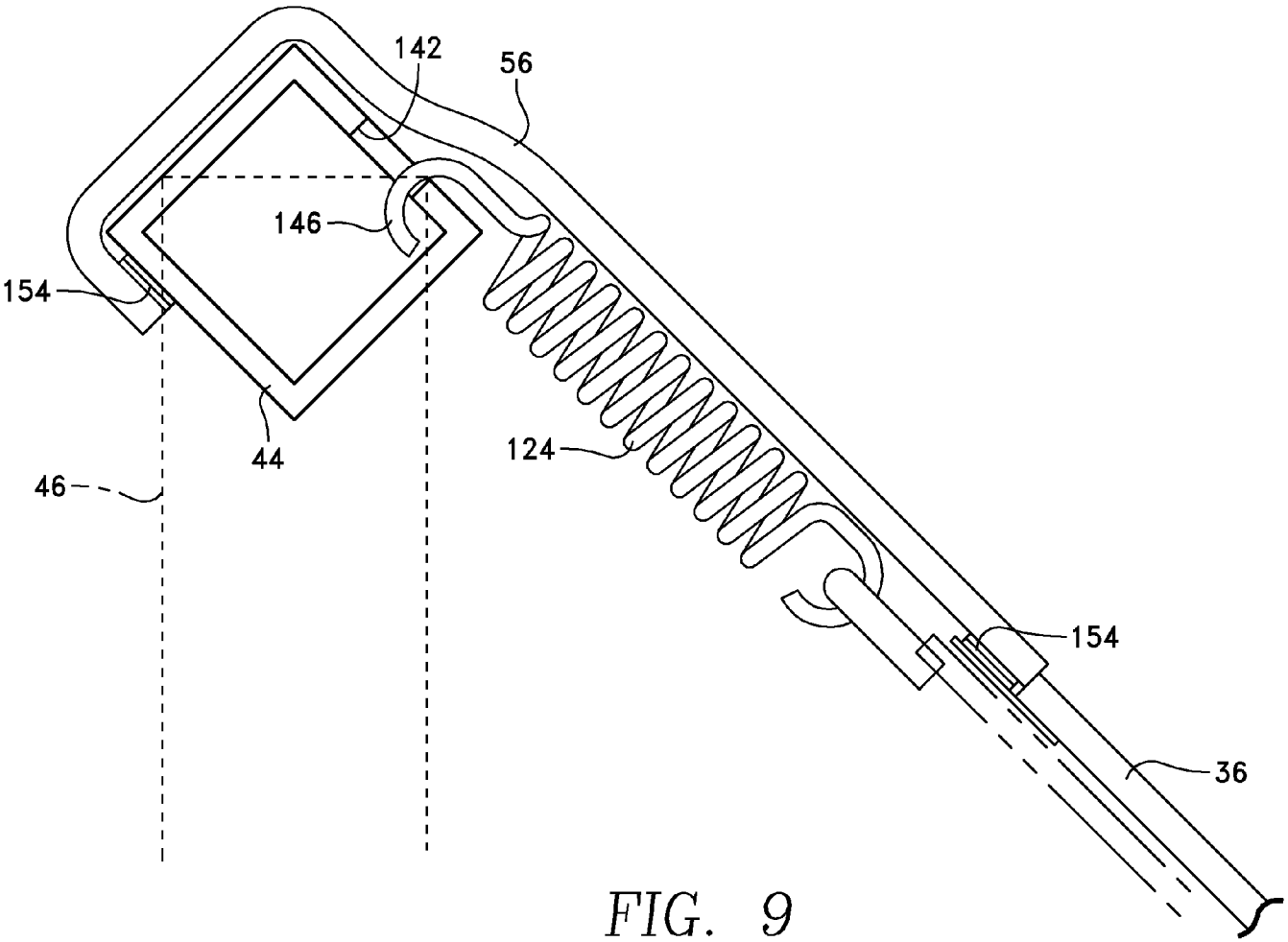
FIG. 9 is a cross-sectional view taken along line 9-9 of FIG. 8 showing a spring connection of a trampoline bed to a peripheral rail in accordance with the present invention.

The springs 124 attach the banked trampoline bed 52 to the trampoline support cabling 26 in much the same manner as previously described. Attachment of the springs 124 to the peripheral rail 44 is best described with reference to FIG. 9. The peripheral rail 44 is preferably fabricated out of tube steel in a rectangular configuration and is rotated 45 degrees when attached to the peripheral support columns 46—as is depicted in FIG. 9. A plurality of spring slots 142 are formed in an inwardly-directed upper face of the peripheral support rail 44 and are dimensioned to receive an extension 146 of the spring 124, securing it in place within the spring slot 142.

FIG. 9 also shows a presently preferred manner of attaching the peripheral rail protective pad 56 to the peripheral rail 44 utilizing a hook-and-loop fastening system 154. This same type of fastening system is also preferred for attachment of the peripheral rail protective pad 56 to the trampoline protective pad 36, as well as the other protective pads to the trampoline beds 14, 52 (not shown in FIG. 9).

Figure 10:
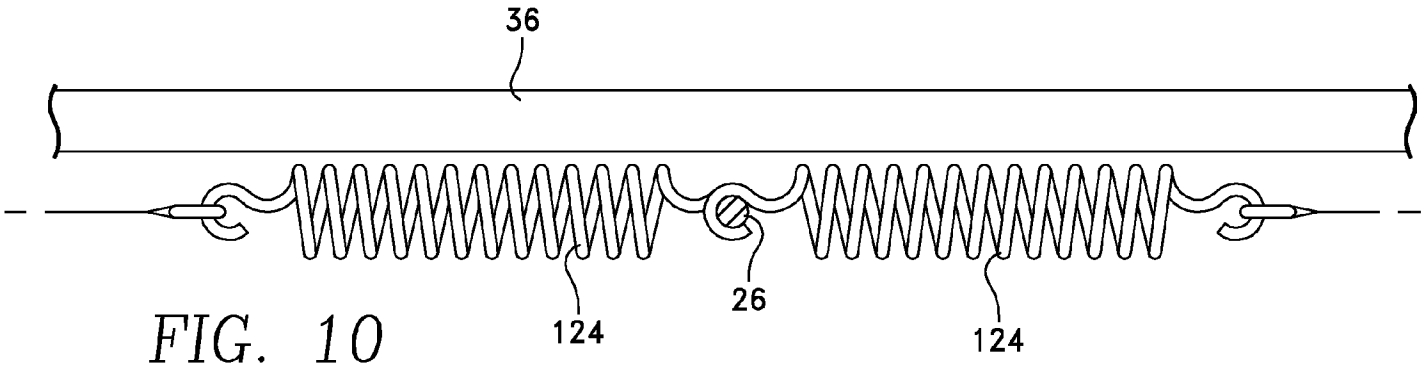
FIG. 10 is a partial sectional view showing a trampoline mat overlying an opposed pair of springs attached to a cable support in accordance with the present invention.
Figure 11:
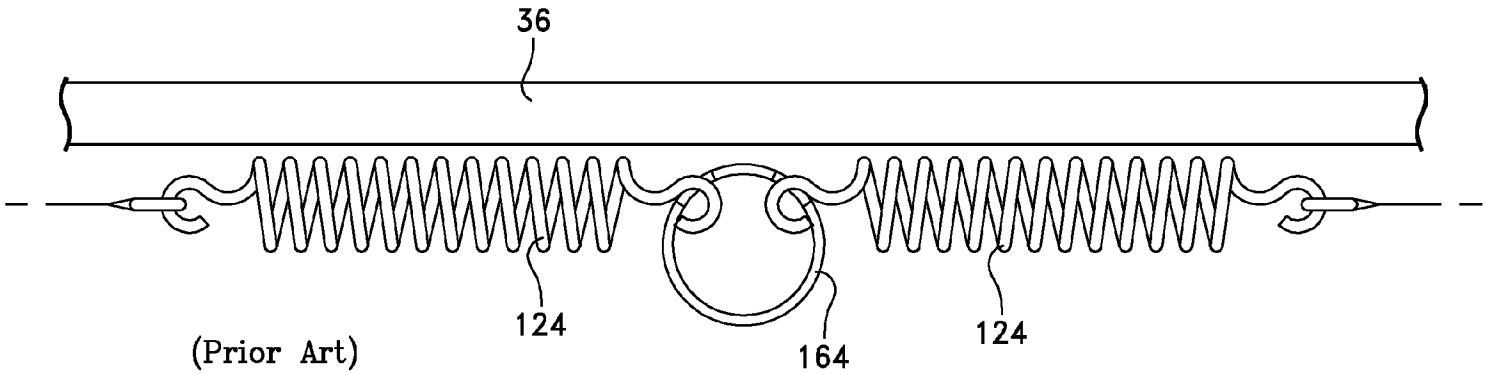
(Prior Art) FIG. 11
FIG. 11 is a partial sectional view, similar to FIG. 10, showing a trampoline mat overlying an opposed pair of springs attached to a rigid member frame support of a prior art trampoline frame.

FIGS. 10 and 11 are provided to illustrate the manner by which the present utilization of trampoline support cabling 26 differs from the use of a rigid support rod 164 in the prior art trampoline support frame designs. Utilization of the present inventive design provides the plurality of individual trampoline support cabling 26 to which the springs 124 are attached. The trampoline protective pad 36 overlies the springs and cable assembly. In contrast, the prior art design of FIG. 11 utilizes a support frame with a rigid support rod 164 to which the springs are attached. Upon jumper impact the rigid support rod does not "give" to the extent of a supported cable, and thus even with placement of protective padding, the risk of injury to the jumper is increased as a result of the rigid trampoline frame of the prior art.

As is generally described above, the segmented cabling system used to support the individual trampoline beds is itself supported by a framing system consisting of vertical and horizontal members. Anchor members are used to connect the vertical members to the ground or flooring, and cross-bracing connecting the vertical members provides short force/load paths to ground.

In a presently preferred manner of fabricating the trampoline park frame, the vertical members consist of both tall and short columns. The taller columns, identified herein as the peripheral support columns 46, are preferably fabricated using 5"×5"×3/16" tube steel, with gusset plates welded to their exterior faces at both top and bottom ends, and a base plate welded to the bottom end. As is illustrated in the Figures, the taller columns are located along the outer peripheral ring of the frame system and are connected laterally at their tops using gusset-ended peripheral rails 44. The kick braces 62 are presently preferably fabricated from angle iron due to its resistive properties.

The shorter columns, identified herein as bed support columns 22 and peripheral support columns 46, provide the direct support to the plurality of trampoline beds and are preferably fabricated using 3"×3"×3/16" tube steel, with gusset plates welded to their exterior faces at both top and bottom ends, and a base plate welded to the bottom end. Shorter columns are located in a grid pattern within the interior of the frame system and are connected laterally at their tops by trampoline bed support cabling. Diagonal cross-brace cabling connects adjacent shorter columns, extending from the top end of one shorter column to the bottom end of an adjacent column.

Although square columns are depicted in the Figures, the present invention also contemplates the use of other geometrical-shaped column sections, such as circular, rectangular, "H," "I" or "C" (stud and MC) sections. The square column section is presently preferred as providing the greatest amount of surface area for connections, as well as the greatest amount of frame configuration versatility (meaning any frame shape can be created). Additionally, the square column section is presently considered to provide the simplest shape to work with and to replace.

The gusset plates are fabricated from plate steel of thickness ranging from 1/4" to 3/8" based upon the highest overall loading. The gusset plates are located and welded to the exteriors of the columns according to their connection type. It is to be understood and appreciated that other connection members could be used in place of the gussets, such as bolts and clips; however, gussets are presently preferred as better transferring the loading as well as limiting the amount and nature of support member deflection.

Base plates are preferably fabricated from plate steel of thickness ranging from 5/16" to 1/2"—again, based upon the highest overall loading, with anchor apertures dimensionally placed at the corners of the base plate for anchoring to the concrete building slab. Both taller and shorter columns are anchored through the base plates—to the concrete building slab—by anchor bolts and steel screw anchors. Alternatively, the columns can be anchored to the flooring using lag anchor bolts or epoxy bolts. The presently-preferred anchor bolt/screw anchors permit the trampoline park frames to be easily dismantled and removed from commercial spaces, and likewise, easily installed. The other, more permanent installation and anchoring methods do not.

Peripheral rails are preferably fabricated using 4"×4"×3/16" tube steel and have gusset plates welded to each end, with apertures dimensionally located therein to permit alignment with the gusset plates located at the top of the taller columns. This construction is shown in FIG. 8.

Trampoline bed support cable assemblies are used to support the trampoline beds through their connections between adjacent taller columns as well as their connections between adjacent shorter columns. Such cable assemblies preferably consist of a cable, a turnbuckle, and a shackle fastened together. In a presently preferred embodiment the cables are fabricated from 7-19 strained galvanized wire ropes, such as the 7-19 strained galvanized wire ropes (also known as "oil field ropes") provided by Bridon American Fabrications of Oakland City, Ind.

Each end of the cable is formed into a loop around a cable thimble, the free cable end being looped around the thimble and fastened with a swaged connection to form an eye-hole at the cable end. A shackle is then used to connect the cable end to the gusset of a support column.

The turnbuckle is adjusted in a conventional manner by rotating (screwing) about its central axis to cause a retraction of the opposing ends, resulting in increasing tension levels in the cable. Once the specified cable tension is reached the trampoline bed support cabling assembly is complete. Cross-brace cabling assemblies are attached to adjacent bed support columns in a similar manner.

Presently acceptable turnbuckles for the above-described application are 1/2"×6" Jaw×Jaw galvanized steel, such as are provided by Cleveland City Forge of Wellington, Ohio. Shackles are preferably 1/2" and are fabricated out of galvanized steel, such as are provided by Cleveland City Forge of Wellington, Ohio.

By way of example and not limitation, construction of the present trampoline park frame is described below. Suitable locations might include an empty commercial space of roughly 75 feet wide by 150 feet long, having a height (generally) of 20 feet. Once the overall boundaries of the trampoline park framework are located within the space, base plate locations are laid out—defining the locations for the taller and shorter columns.

The base plates and columns are then anchored to the floor (concrete slab) and the various cabling members are attached—the horizontal defining the trampoline array, the upward and downward cabling for the perimeter trampolines, and the cross-bracing cabling providing a load path that is immediate, with little or no column-to-column transfer of force. Horizontal peripheral rails and kick braces are connected to the taller columns to complete the reinforcing structure for the trampoline park frame perimeter.

Springs are then secured to the horizontal cabling and the perimeter rails, followed by installation (and subsequent tensioning) of the trampoline mats, forming the trampoline beds. Tensioning of the trampoline bed support cables follows, and final tensioning adjustments are made to the cross-bracing cables. Protective pads are placed over the trampoline bed support cables and springs to complete the installation. Removal of the trampoline park frame assembly generally follows the reverse of the preceding steps.

My invention has been disclosed in terms of a preferred embodiment thereof, which provides a trampoline park frame that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A trampoline park frame comprising:

a plurality of support columns arranged in a rectangular grid array;

a plurality of support cabling, each of said plurality of support cabling individually attached to and extending between a separate adjacent pair of said plurality of support columns in a manner such that collectively said plurality of attached support cabling and said support columns define a plurality of trampoline support grid arrays;

a plurality of diagonal cross-brace cabling, each of said plurality of diagonal cross-brace cabling attached to and extending vertically diagonal between a separate one of said separate adjacent pairs of said plurality of support columns;

a plurality of peripheral support columns extending in a grid array about an outer periphery of said plurality of trampoline support grid arrays, wherein a separate one of said plurality of support cabling is attached to and extends between each of said plurality of peripheral support columns and a separate adjacent one of said plurality of support columns;

a plurality of kick braces, each of said plurality of kick braces is attached to a separate one of said plurality of peripheral support columns and extends and is attached to said separate adjacent one of said plurality of support columns to which said separate one of said plurality of support cabling is attached; and a plurality of peripheral rails, each of said plurality of peripheral rails is attached to and extends between a separate pair of said plurality of peripheral support columns.

2. The trampoline park frame of claim 1, and further comprising a plurality of downward cable assemblies, each of said plurality of downward cable assemblies attached to and extending between each of said plurality of peripheral support columns and a separate adjacent one of said plurality of support columns.

3. The trampoline park frame of claim 2, and further comprising a plurality of floor cable anchor plates extending in a grid array about an outer periphery of said plurality of trampoline support grid arrays, wherein a separate one of said plurality of downward cable assemblies is attached to and extends between each of said plurality of peripheral support columns and a separate adjacent one of said plurality of support columns and between each of said plurality of floor cable anchor plates and a separate adjacent one of said plurality of support columns.

4. The trampoline park frame of claim 3, wherein said plurality of peripheral support columns and said plurality of floor cable anchor plates define alternating grid arrays about said outer periphery of said plurality of trampoline support grid arrays.

5. The trampoline park frame of claim 3, and further comprising a plurality of trampoline beds, each of said plurality of trampoline beds received in and attached to a separate one of said plurality of trampoline support grid arrays.

6. The trampoline park frame of claim 5, and further comprising a plurality of trampoline protective pads, each of said plurality of trampoline protective pads attached to and extending between a separate adjacent pair of said plurality of trampoline beds in a manner such that each of said plurality of trampoline protective pads substantially overlies a separate one of said plurality of support cabling.

7. The trampoline park frame of claim 6, and further comprising a plurality of support column protective pads, each of said plurality of support column protective pads overlies a separate one of said plurality of support columns and is attached to at least one of said plurality of trampoline protective pads.

8. The trampoline park frame of claim 7, and further comprising a plurality of banked trampoline beds, each of said plurality of banked trampoline beds attached to and extending between a separate one of said plurality of peripheral rails, an adjacent pair of said plurality of support cabling attached to an adjacent pair of said plurality of peripheral support columns, and an adjacent pair of said plurality of trampoline support grid arrays.

9. The trampoline park frame of claim 8, and further comprising a plurality of peripheral rail protective pads, each of said plurality of peripheral rail protective pads overlying a separate one of said plurality of peripheral rails and attached to an adjacent one of said plurality of banked trampoline beds.

10. A trampoline park comprising:

a trampoline park frame having a plurality of trampoline support grid arrays arranged in parallel rows, each of said trampoline support grid arrays comprising:

a plurality of support columns arranged in a grid array, a plurality of support cabling, each of said plurality of support cabling individually attached to and extending between a separate adjacent pair of said plurality of support columns, and a plurality of diagonal cross-brace cabling, each of said plurality of diagonal cross-brace cabling attached to and extending vertically diagonal between a separate one of said separate adjacent pairs of said plurality of support columns; and a plurality of trampoline beds, each of said plurality of trampoline beds received in and attached to a separate one of said plurality of trampoline support grid arrays.

11. The trampoline park of claim 10, wherein said trampoline park frame has a plurality of peripheral support grid arrays extending in a grid array about a periphery of said trampoline support grid arrays, each of said peripheral support grid arrays comprising:

an adjacent pair of peripheral support columns, a separate one of said plurality of support cabling attached to and extending between each of said adjacent pair of peripheral support columns and a separate support column of an adjacent one of said trampoline support grid arrays, a peripheral rail attached to and extending between said adjacent pair of peripheral support columns, and a pair of kick braces, each attached to a separate one of said adjacent pair of peripheral support columns and extending and attached to separate ones of said separate support columns of said adjacent one of said trampoline support grid arrays.

12. The trampoline park of claim 11 and further comprising a plurality of banked trampoline beds, each of said plurality of banked trampoline beds attached to and received by a separate one of said plurality of peripheral support grid arrays.

13. The trampoline park of claim 12, and further comprising a plurality of downward cable assemblies, each attached to and extending between a separate one of said plurality of adjacent pairs of peripheral support columns and a separate one of said separate support columns of said adjacent one of said trampoline support grid arrays.

14. The trampoline park of claim 13, and further comprising a plurality of floor cable anchor plates extending in a grid array about an outer periphery of said plurality of trampoline support grid arrays, wherein a separate one of said plurality of downward cable assemblies is attached to and extends between each of said plurality of peripheral support columns and a separate one of said separate support columns of said adjacent one of said trampoline support grid arrays and to each of said plurality of floor cable anchor plates.

15. The trampoline park of claim 14, wherein the peripheral support columns and the floor anchor plates define alternating grid arrays about the outer periphery of the plurality of trampoline support grid arrays.

16. The trampoline park of claim 15 and further comprising a plurality of trampoline protective pads, each attached to and extending between a separate adjacent pair of said plurality of trampoline beds.

17. The trampoline park of claim 16 and further comprising a plurality of peripheral rail protective pads, each overlying a separate peripheral rail of said plurality of peripheral support grid arrays and attached to an adjacent one of said plurality of banked trampoline beds.

* * * * *